United States Patent [19]

O'Neill

[11] 4,269,537

[45] May 26, 1981

[54] REVETMENT UNIT

[76] Inventor: Raymond J. O'Neill, 11 Chippewa Rd., Yonkers, N.Y. 10710

[21] Appl. No.: 6,911

[22] Filed: Jan. 26, 1979

[51] Int. Cl.[3] ..... E02B 3/06

[52] U.S. Cl. ..... 405/29; 46/25; 52/608; 405/33; D25/80; D25/93

[58] Field of Search ..... 405/29–35, 405/15, 25, 16, 17; 52/608, 574, 575, 593, 594; 46/23, 24, 25; D25/80, 93, 97; 404/41

[56] References Cited

U.S. PATENT DOCUMENTS

| | | | |
|---|---|---|---|
| 472,590 | 4/1892 | Simpson | 52/574 |
| 3,368,357 | 2/1968 | Takamori | 405/29 |
| 3,614,446 | 10/1971 | Leuthold et al. | 52/608 |
| 3,759,043 | 9/1973 | Tokunaga | 405/30 |

FOREIGN PATENT DOCUMENTS

| | | | |
|---|---|---|---|
| 141990 | 7/1951 | Australia | 52/575 |
| 851670 | 1/1940 | France | 404/41 |

OTHER PUBLICATIONS

"Sta-Pod," A Technical Brochure Available from Marine Modules Inc., Dept. W, P.O. Box 333, Yonkers, N.Y. 10710.

Offenlegungsschrift-2,120,256, 11/16/72.

*Primary Examiner*—Alexander Grosz

*Attorney, Agent, or Firm*—Hopgood, Calimafde, Kalil, Blaustein & Lieberman

[57] ABSTRACT

An improved revetment construction is provided. Each individual revetment unit has a base section and legs extending from its corners, the legs and base sections are so constructed and arranged that the individual units when placed in array interlock with each other, yet permit water inflow and outflow. The interlocking action is provided even though the individual units are not contacting each other. A variety of arrangements may be provided on the base section to control wave action. The units may also be inverted to further provide wave control action.

12 Claims, 10 Drawing Figures

REVETMENT UNIT

BACKGROUND AND SUMMARY OF THE INVENTION

This invention relates generally to revetments used to protect land masses from wave and water action. Such revetments have generally been stone and stone filled wired baskets. The stone revetments require heavy cap stones to stay in place during heavy wave action as the weight of the stones is the only means to prevent dislodging. The stone-filled wire baskets provide a more economical solution to the problem, but are subject to ripping or tearing by floating debris and the corrosive effects of water. Additionally, such structures require relatively large amounts of time to construct.

Recently, revetment constructions utilizing cast concrete have become known. These constructions use lapped, or tongue and groove, joints to form an interlocketing revetment. However, such constructions require a smooth surface on which the units are to be set in order to provide a tight interlocking fit. The interlock of the units may be defeated should the surface on which they are set, be curved. Additionally, settlement of the units due to wave impact will loosen the interlock of the units. Finally, when such units are interlocked they form a solid mass which presents water inflow and outflow.

Generally speaking, in accordance with the invention, a revetment construction is provided which is directed to overcoming the above-noted disadvantages. The construction is assembled from a plurality of individual units which include a generally planar base and four extending legs. The angle of the legs and the base are constructed and arranged so that when an array of units is fitted together the legs will interlock with the base of other revetment units to prevent same from being dislodged by wave or water action. Even though interlocked, the units provide spaces for water movement to control water pressure uplift. The construction also permits the units to remain interlocked even though placed on a non-level or curved bed. A variety of arrangements may be provided on the units to control wave action. The units themselves can also be inverted to control wave action.

Accordingly, it is an object of the invention to provide an improved revetment constructed from interlocking individual units.

Another object of this invention is to provide an improved revetment unit that remains flexible even though interlocked.

Another object of this invention is to provide a revetment unit that permits the passage of water between each individual unit even though interlocked.

Another object of this invention is to provide an improved revetment that will remain interlocked even though each individual unit does not contact the other units.

Another object of this invention to provide an improved revetment that may be placed on a non-level surface, yet remain interlocked.

Another object of this invention is to provide an improved revetment that may be inverted.

Another object of this invention to provide an improved revetment unit which may include a variety of wave energy dissipation means.

Another object of this invention is to provide an improved revetment unit that may be produced by automated concrete casting machines.

Still other objects of this invention will become apparent upon a reading of the detailed specification to follow.

DESCRIPTION OF THE PREFERRED EMBODIMENTS

Figure 1:
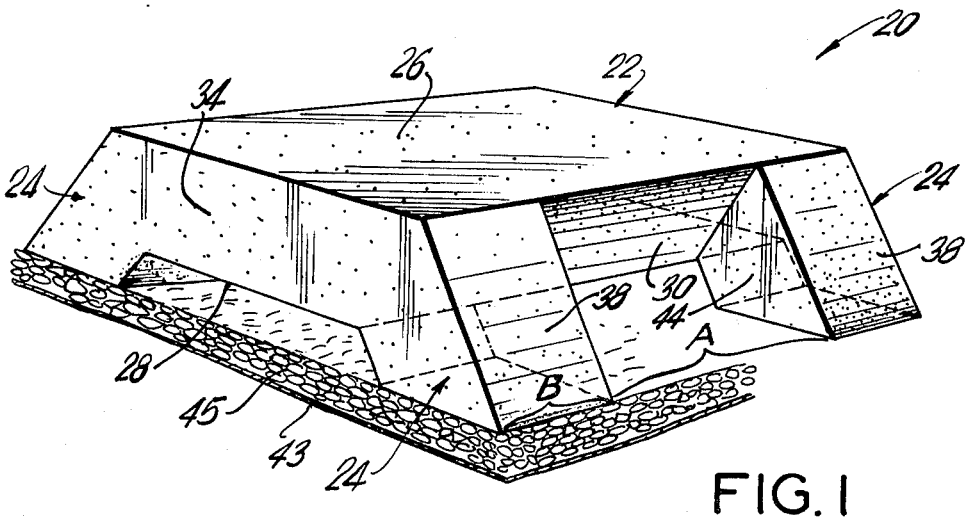
FIG. 1 is a perspective unit of an individual revetment unit constructed in accordance with a preferred embodiment of the invention.
Figure 2A:
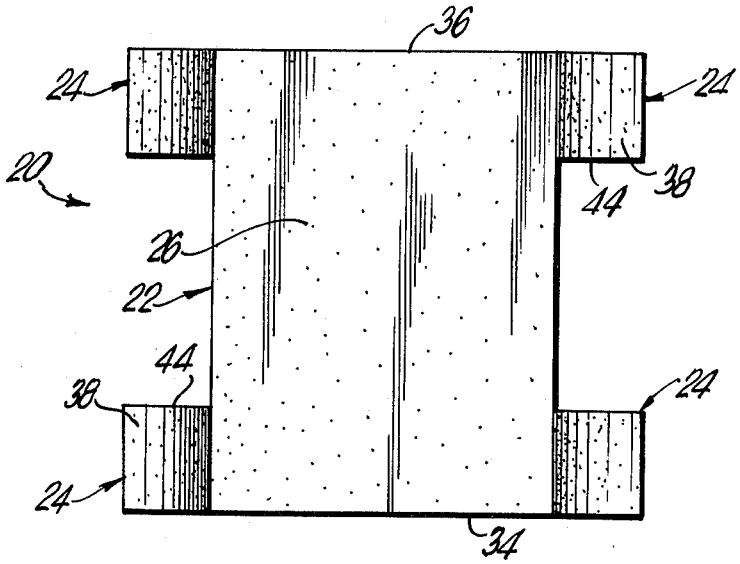
FIGS. 2*a* and 2*b* are a top plan view and a sectional view respectively of the revetment unit.
Figure 2B:
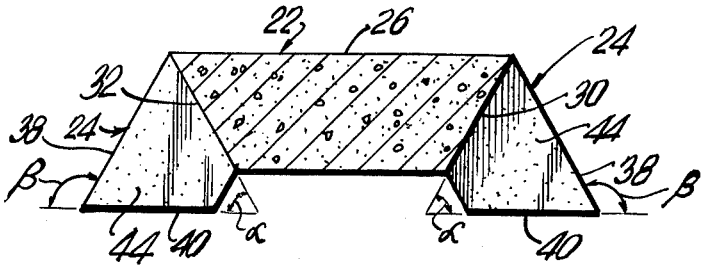

FIGS. 1, 2*a* and 2*b* illustrate a preferred embodiment of a revetment unit 20 which includes a base 22 and four legs 24. Base 22 has an upper rectangular surface 26 and a lower rectangular surface 28 which is of smaller area than that of upper surface 26. Legs 24 extend below lower surface 28 and beyond the periphery of upper surface 26 and may be cast in lengths to suit various surface conditions. Joining upper surface 26 and lower surface 28 are side-walls 30, 32 and end-walls 34, 36. Side-walls 30, 32 extend at an angle $\alpha$ with respect to the surface upon which revetment unit 20 rests, and thus base 22 of revetment unit 20 in cross-section is trapezoidal with the longest base upward.

Legs 24 extend from each corner of base 22 and include outer surfaces 38 at an angle $\beta$ with respet to the surface upon which they rest. Each leg 24 includes an inner side wall 44 and a lower surface 40 which supports revetment unit 20. Angles $\alpha$ and $\beta$ are supplementary angles, that is, together they add up to 180 degress. The distance between legs 24 along sidewalls 30, 32 is greater than twice the width B of each leg which together with the angled surfaces 38 and side-walls 30, 32 permit a number of revetment units to be interlocked on level or non-level ground as is described below.

Figure 3:
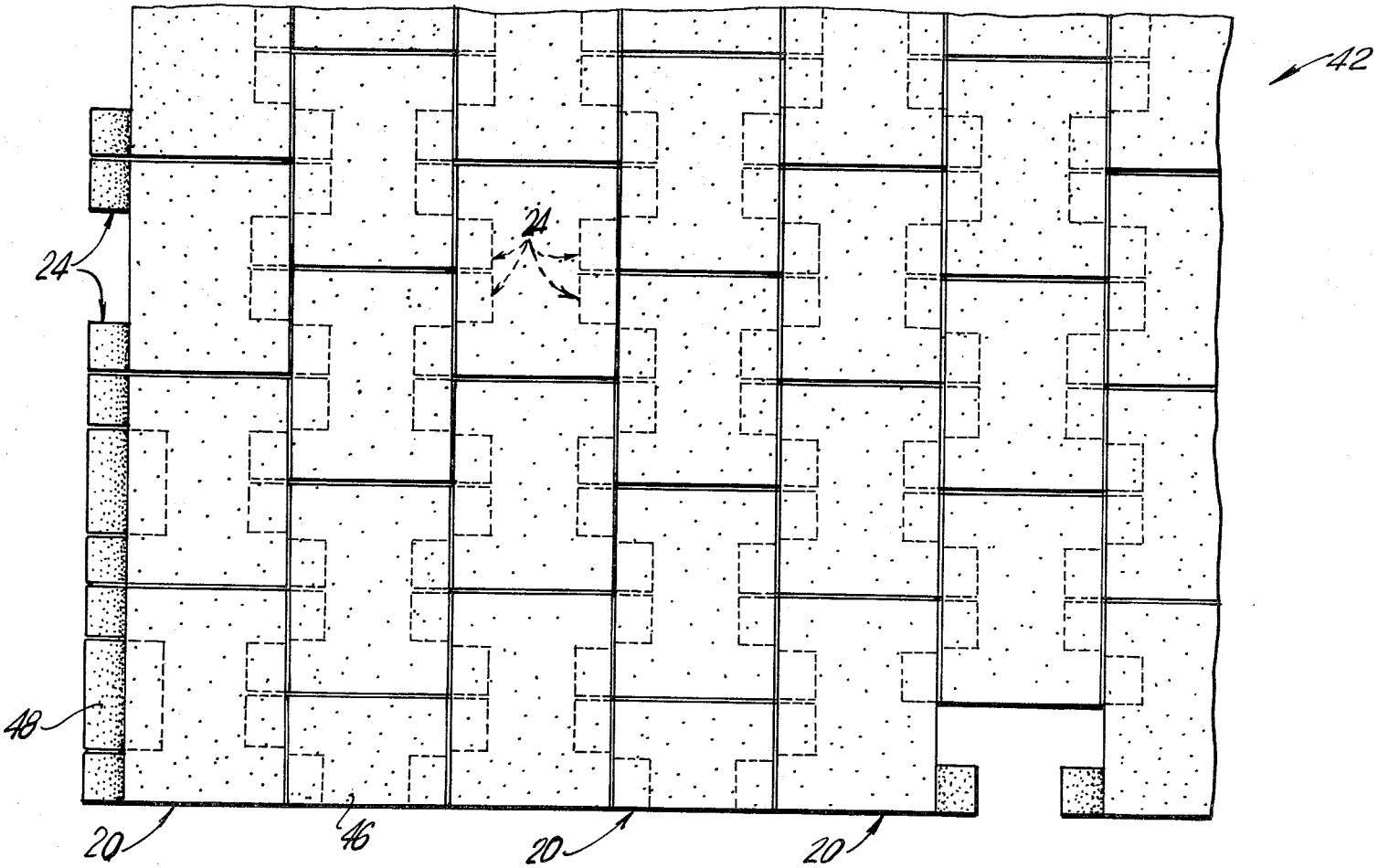
FIG. 3 is a top plan view of an array of interlocked revetment units.

FIG. 3 shows an array 42 of revetment units 20 showing the interlocking feature. As shown, each row of units 20 is offset with respect to the next row, one-half of the length of each unit 20, and each unit 20 is placed with legs 24 along each side extending between the legs of the two units 20 in the next row. Thus, between legs 24 of each unit 20 will be two legs 24 of the next row. Units 20 need not contact the others and are preferably spaced apart to allow the inflow and outflow of water. Even if vigorous wave action takes place, the hydrostatic pressure may lift on individual unit 20 but will not dislodge it, since the outer surfaces 38 of legs 24 will contact side walls 30 of units in adjacent rows to prevent unit 20 from being dislodged. No unit 20 can be removed by water action without the shearing of legs or lifting the entire array 42. Thus it is seen that the angled construction of sidewalls 30 and legs 24 assures interlock of units 20 regardless of the surface up on which they are placed. The present construction permits the interlock of array 42 to tighten as units 20 settle due to wave impact, precisely the opposite of what happens in conventional constructions. In order to rectangularize array 42, end filler units 46 and side filler units 48 are added along its periphery.

A preferred material for the construction of revetment units 20 is dry or wet case concrete, which need not be reinforced. Units 20 can be produced by automation on machines that are used to produce pipe by the dry pack method. Filler pieces may be added to the molds to provide various sizes of legs 24 and base 22. A preferred support for revetment unit 20 is a filter fabric 43 over the soil to prevent erosion and a stone bedding 45 between filter fabric 43 and revetment units 20 to distribute their weight and smooth minor irregularities.

Figure 4:
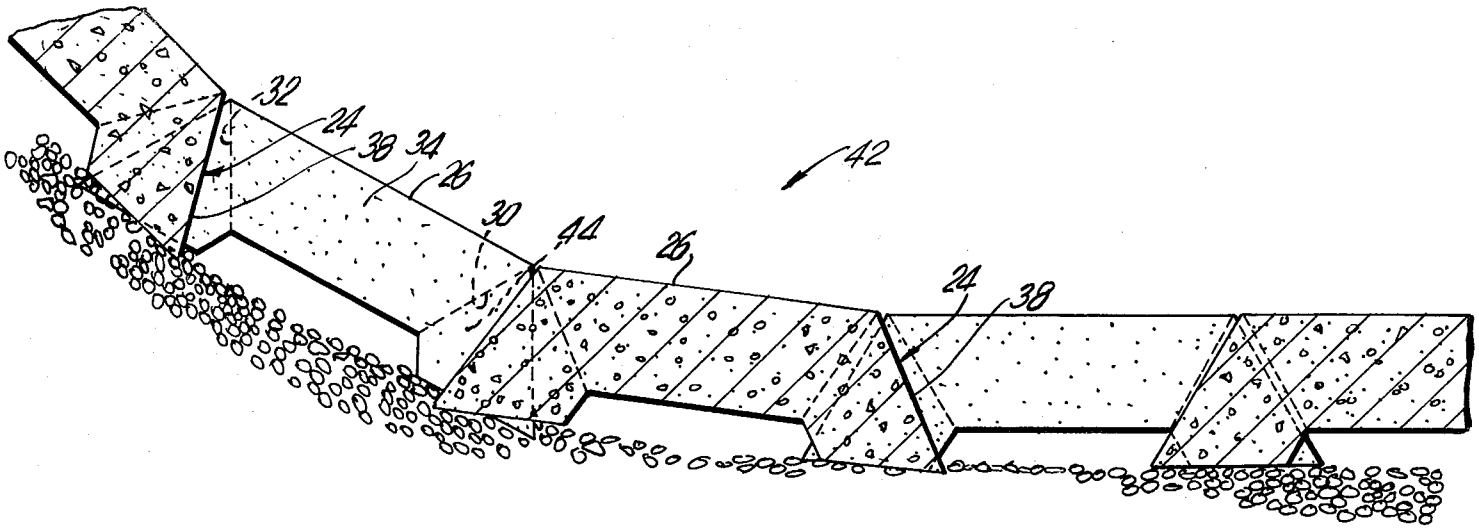
FIG. 4 is a cross-sectional view of the revetment units in place on a curved surface.
Figure 5:
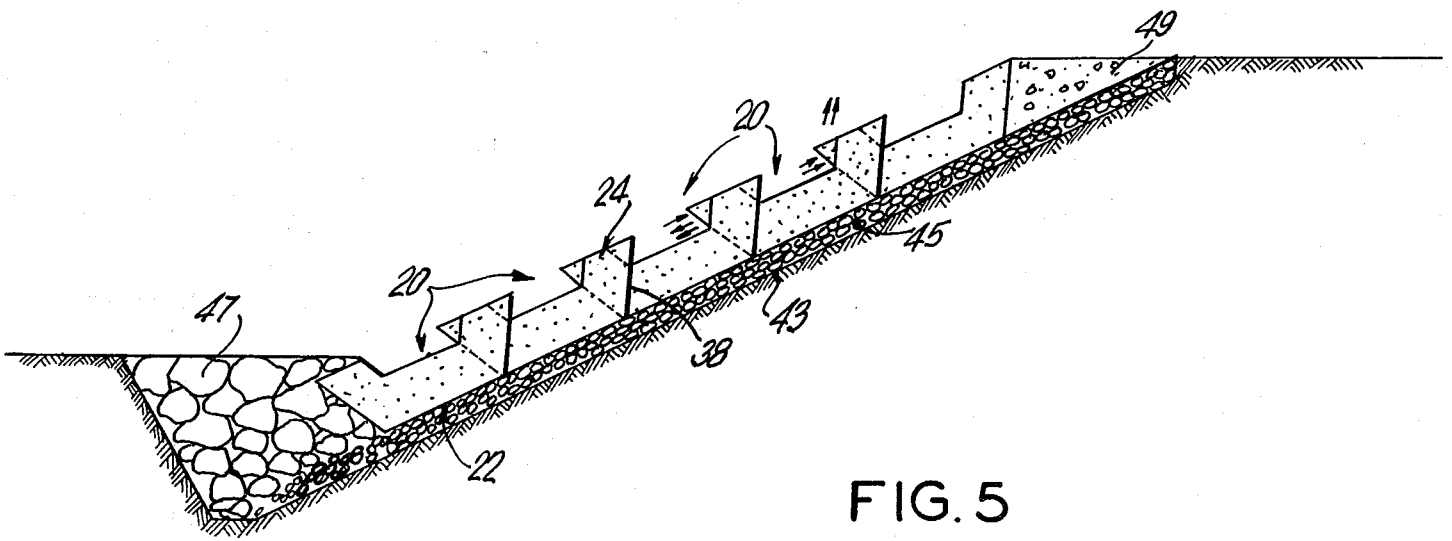
FIG. 5 is a sectional view of the revetment in place, with each individual unit inverted for the control of wave action.

As can be seen in FIG. 4, the interlock of array 42 is not lost if it is placed on a curved surface since outer surfaces 38 of legs 24 will still contact sidewalls 30 of base 22 of the adjacent units 20 should a single unit 20 be uplifted, and accordingly no unit 20 will become dislodged due to wave or water action on the surface. Furthermore, as is shown in FIG. 5, the revetment units may also be inverted with legs 24 extending upwardly and bases 22 placed downwardly. In this inverted arrangement, the interlock between units 20 remains the same, since upon uplift sidewalls 30 of bases 22 will contact outer surfaces 38 of legs 24 to keep same from becoming dislodged. Additionally, in this arrangement, the angled outer surface 38 of legs 24 serve to dissipate the wave energy since such waves will be deflected by contact with legs 24. In this arrangement, a stone toe 47 at array 42's base and a concrete walk 49 anchors it in place.

Figure 6A:
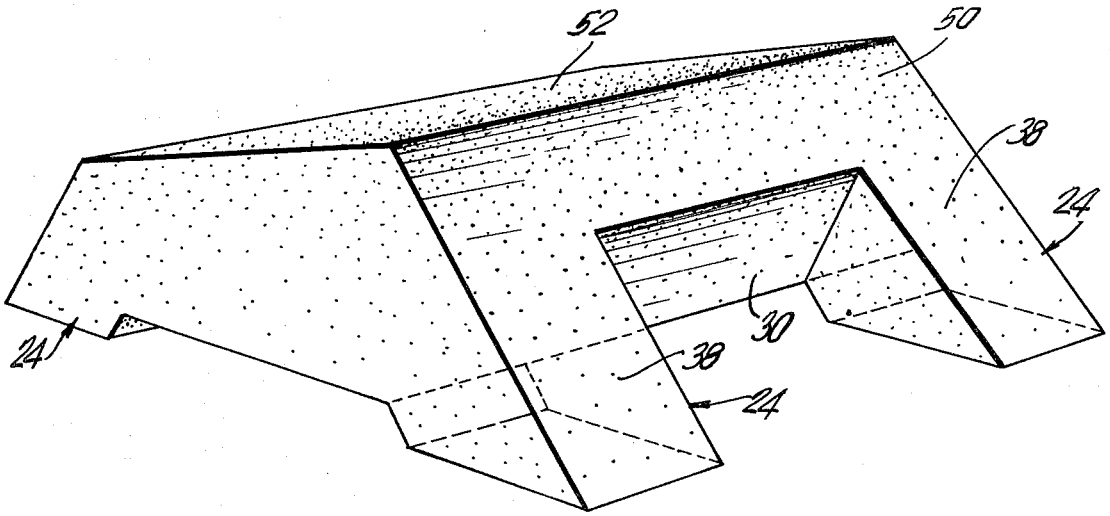
FIGS. 6*a* and 6*b* show other preferred embodiments of the revetment unit for control of wave action.
Figure 6B:
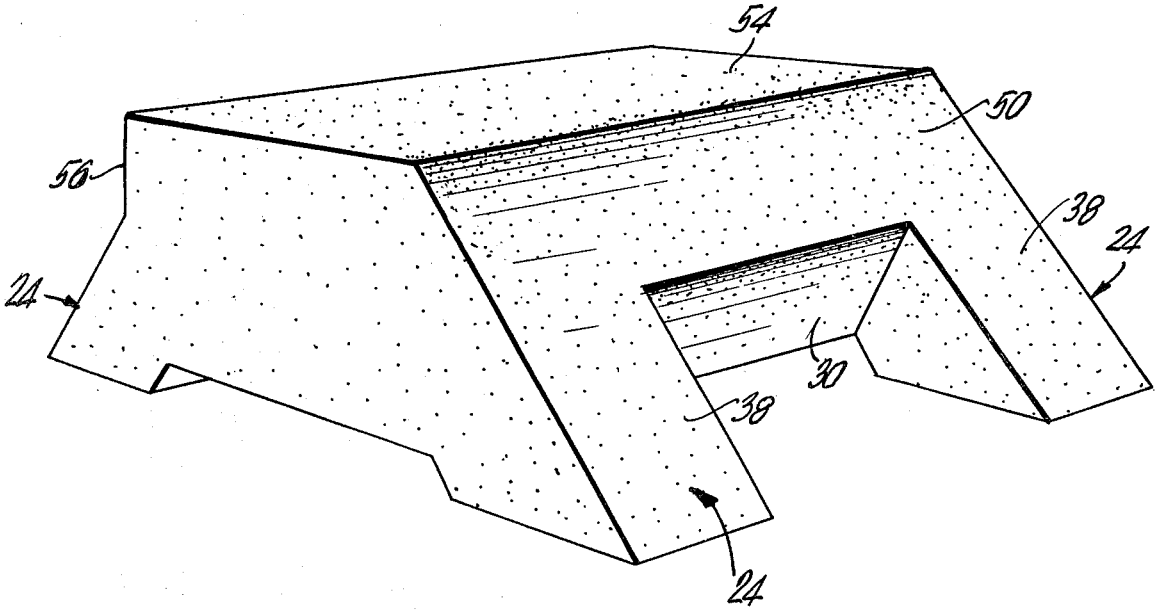

FIGS. 6*a* and 6*b* illustrate various other revetment unit arrangements including hydraulic jumps to dissipate wave energy. In these figures, like reference numbers refer to like structure with the added reference numbers detailing additional structure. FIG. 6*a* illustrates an embodiment in which a sloped face 50 has been added in line with outer surface 38 of legs 24 and a further sloped face 52 extends from sloped face 50 to the upper portions of the rear legs 24. FIG. 6*b*, illustrates an embodiment in which sloped face 50 is joined to a horizontal surface 54 which joins a vertical surface 56 extending upwardly from the rear legs 24. These embodiments are particularly directed to providing surfaces which will dissipate wave action by the deflection of the wave as it passes over the sloped surfaces. Other upper surface arrangements, such as ripples, can be incorporated into individual revetment units 20 for similar energy dissipation purposes. Another means of reducing wave runup is to intermingle various sizes of units 20 to provide an uneven surface to dissipate the energy.

Figure 7:
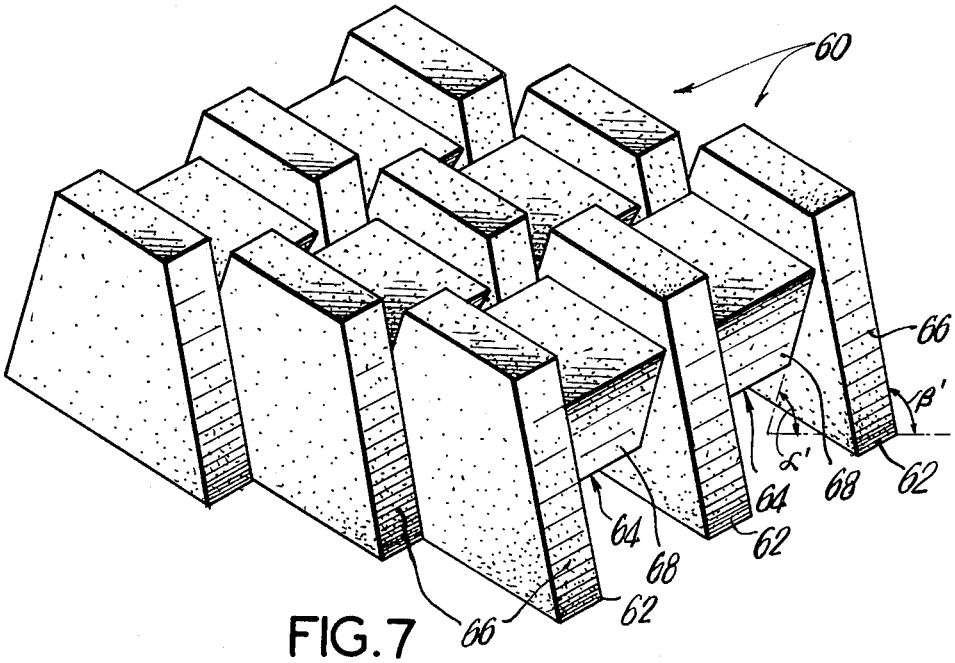
FIG. 7 is a perspective view of revetment units constructed in accordance with another preferred embodiment of the instant invention.
Figure 8:
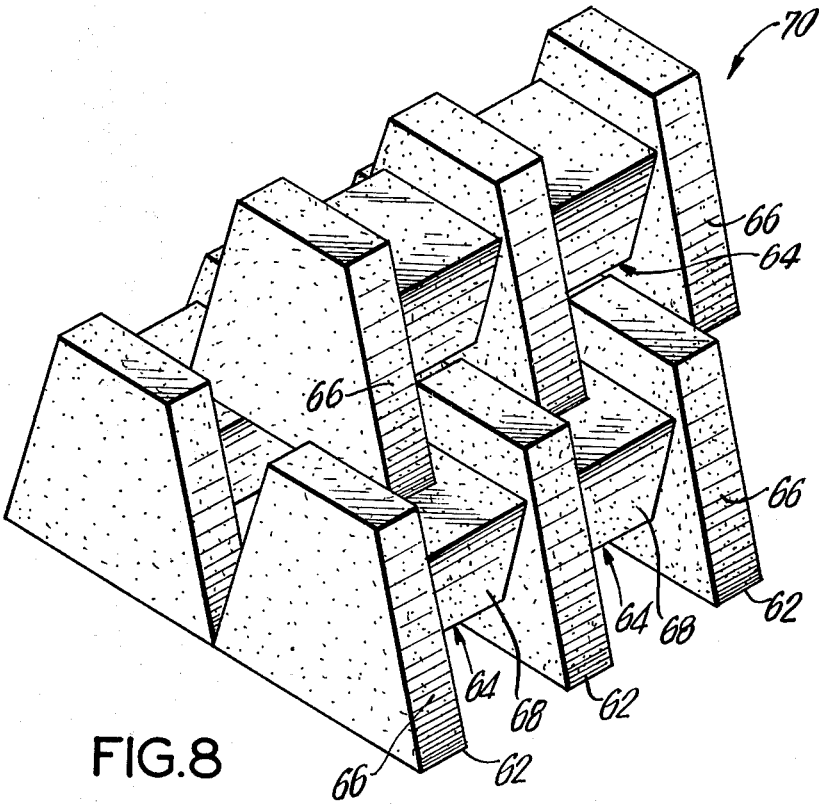
FIG. 8 shows the units of FIG. 7 stocked so as to form a barrier wall.

FIGS. 7 and 8 illustrate yet another preferred embodiment of the revetment unit in accordance with the invention. In this embodiment each revetment unit 60 includes three upstanding leg units 62 separated by two base units 64. Each leg unit 62 is in the form of a trapezoid with its base resting on the ground. The outer wall 66 of each unit 62 extends at an angle $\beta'$ with respect to the ground. Each base unit 64 is in the form of a trapezoid with its base at the top and has an outer wall 68 which extends at an angle $\alpha'$ with respect to the ground. Angles $\alpha'$ and $\beta'$ are supplementary angles to again provide the interlocked arrangement, as previously described with respect to the other embodiments and as shown in FIG. 7.

The upper and lower portions of each leg unit 62 extends beyond the upper and lower portion of each base unit 64 to permit various units 60 to stack atop each other so as to form a barrier wall arrangement 70 as shown in FIG. 8. The interengagement of the leg portions 62 will prevent each unit 60 from being displaced with respect to each other along their longitudinal axes.

As many units 60 as is required make be stacked atop each other. Such arrangements may be used as revetments, seawalls, dams, etc. as needed. The large number of surfaces provided by this embodiment also acts to dissipate wave energy.

Although the present invention has been described in conjunction with preferred embodiments, it is to be understood that modifications and variations may be resorted to without departing from the spirit of the scope of the invention, as those skilled in the art will readily understand. Such modifications and variations are considered to be within the purview and scope of the invention and the appended claims.

What is claimed is:

1. A revetment unit for interengagement with other similar revetment units comprising a base, said base being trapezoidal in section and the sides of said trapezoid forming the outer surface of said base, leg means extending from said base to support said base, said leg means extending beyond the periphery of said base and extending below the underside of said base to space the underside of said base above the surface upon which said unit rests, said outer surface of said base being inclined at an angle $\alpha$ with respect to the surface upon which said unit rests, said leg means extending from said base at an angle $\beta$ with respect to the surface upon which said unit rests, said angles $\alpha$ and $\beta$ being generally supplementary to permit interlocking engagement of said leg means and said outer surface of said similar unit to prevent relative movement between said unit and said another similar unit.

2. The revetment unit as claimed in claim 1, wherein said base is generally rectangular in plan view.

3. The revetment unit as claimed in claim 1, wherein the distance between said leg means along the longitudinal extent of said base is greater than twice that of the width of said leg means.

4. The revetment unit as claimed in claim 1, wherein said base further includes means for dissipating wave action.

5. The revetment unit as claimed in claim 4, wherein said dissipating means comprise a surface inclined with respect to said base.

6. The revetment unit as claimed in claim 4, wherein said base includes a surface normal to said base.

7. The revetment unit as claimed in claim 1, wherein said revetment unit comprises a unitary casting.

8. A revetment unit for interengagement with similar revetment units comprising a base, leg means to support said base, said legs means extending beyond the periphery of said base, said leg means including an outer surface extending at an angle $\beta$ with respect to the surface upon which said unit rests, said leg means extending below the underside of said base to space the underside of said base above the surface upon which said unit rests, said base including sidewalls extending at an angle $\alpha$ with respect to the surface upon which said unit rests, and said angle $\beta$ and $\alpha$ being generally supplementary to permit said outer surface of said leg means to contact said side of said base of said similar revetment units to permit interlocking of similar revetment units to prevent relative movement between said units.

9. The revetment unit as claimed in claim 8, wherein said base of said revetment unit is generally rectangular in plan view.

10. The revetment unit as claimed in claim 8, wherein said leg means comprise four legs located at the corners of said generally rectangular base.

11. The revetment unit as claimed in claim 8, wherein said leg means are spaced apart a distance at least twice as great as that of the width of said outer surface of said leg means.

12. The revetment unit as claimed in claim 8, wherein said unit includes three leg means in the form of a trapezoid with its longest parallel wall downward, and wherein the upper portion of each said leg means extends above the upper portion of said base.

* * * * *